US009341429B1

(12) United States Patent
Reavis, III

(10) Patent No.: US 9,341,429 B1
(45) Date of Patent: May 17, 2016

(54) EJECTION PORT COVER FOR A FIREARM

(71) Applicant: Johnson Paul Reavis, III, Christiana, TN (US)

(72) Inventor: Johnson Paul Reavis, III, Christiana, TN (US)

( * ) Notice: Subject to any disclaimer, the term of this patent is extended or adjusted under 35 U.S.C. 154(b) by 0 days.

(21) Appl. No.: 14/846,644

(22) Filed: Sep. 4, 2015

Related U.S. Application Data

(60) Provisional application No. 62/045,725, filed on Sep. 4, 2014.

(51) Int. Cl.
*F41A 35/02* (2006.01)

(52) U.S. Cl.
CPC ..... *F41A 35/02* (2013.01)

(58) Field of Classification Search
CPC ..... F41A 35/02; F41A 35/00; F41C 27/00; F41C 23/02
USPC ..... 42/47, 85, 90, 96, 98, 106
See application file for complete search history.

(56) References Cited

U.S. PATENT DOCUMENTS

| | | | | |
|---|---|---|---|---|
| 1,878,038 | A * | 9/1932 | Von Frommer | F41A 35/02 42/16 |
| 3,938,271 | A * | 2/1976 | Hyytinen | F41A 35/02 42/16 |
| 5,918,401 | A * | 7/1999 | Rowlands | F41A 35/02 42/14 |
| 7,181,881 | B2 * | 2/2007 | Fischbach | F41A 15/00 42/71.01 |
| 8,448,363 | B2 * | 5/2013 | Fargnoli | F41A 3/54 42/16 |
| 8,800,192 | B2 * | 8/2014 | Brown | F41A 3/66 42/16 |
| 2003/0230020 | A1 * | 12/2003 | Christiansen | F41A 35/02 42/1.05 |
| 2005/0016051 | A1 * | 1/2005 | Fischbach | F41A 15/00 42/96 |
| 2010/0000139 | A1 * | 1/2010 | Brown | F41A 3/66 42/96 |
| 2014/0026457 | A1 * | 1/2014 | Brown | F41A 3/66 42/16 |
| 2015/0285579 | A1 * | 10/2015 | Hawley | F41A 35/02 42/96 |

FOREIGN PATENT DOCUMENTS

| | | | | |
|---|---|---|---|---|
| GB | 273301 A * | 1/1928 | | F41A 35/02 |

OTHER PUBLICATIONS

Website for Bullpupforum.com https://bullpupforum.com/index.php?topic=3612.0 entree dated Jul. 26, 2013.*
Website for "The Bangswitch" (Military Arms Channel Blog) http://www.thebangswitch.com/dealing-with-the-tavors-gas-gearhead-works-flex/ entree dated Oct. 2, 2013.*
Website for "Shooters Loft" forum http://www.shootersloft.com/forums/index.php?/topic/1614-dealing-with-the-tavors-gas-gearhead-works-flex/ entree dated Oct. 3, 2013.*
Gear head Works, "FLEX swivel prototype demo", youtube.com, Aug. 26, 2013, https://www.youtube.com/watch?v=9OJATcwIG_I.

* cited by examiner

*Primary Examiner* — Benjamin P Lee
(74) *Attorney, Agent, or Firm* — Eric B. Fugett; Blake M. Bernard; Waller Lansden Dortch & Davis, LLP

(57) ABSTRACT

A device for covering a firearm ejection port, the firearm including a receiver having an interior and an exterior side, the ejection port defined in the receiver, the ejection port having an upper peripheral edge and a notch defined in the upper peripheral edge. The device includes a backing member positionable across the ejection port from an interior side of the receiver. A cover is positionable over the ejection port from an exterior side of the receiver. A fastener extends between the backing member and the cover, the fastener being operable to selectively tighten the backing member and the cover together to clamp the cover over the ejection port. The cover is positioned over the notch in the ejection port when the cover is clamped over the ejection port to prevent gas in the receiver from passing through the notch.

20 Claims, 10 Drawing Sheets

EJECTION PORT COVER FOR A FIREARM

CROSS-REFERENCES TO RELATED APPLICATIONS

This application claims priority to and hereby incorporates by reference in its entirety U.S. Provisional Patent Application Ser. No. 62/045,725 entitled GAS SEALING EJECTION PORT COVER, filed on Sep. 4, 2014.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to ejection port covers for firearms and more specifically to ejection port covers having one or more dynamic sealing characteristics.

Many firearms available today, including but not limited to various automatic and semi-automatic rifles, are designed with a receiver having an ejection port defined therein. The ejection port allows for ejection of spent shell cases from the receiver each time a round of ammunition is fired. More specifically, when a round is fired, a portion of the hot, high-pressure gas that results from ignition of propellant (e.g., gun powder) contained with the round is used to power a mechanism that extracts the spent case and chambers a new round. However, high-pressure gases, heat, and powder residue are also often released through the ejection port during operation of such firearms. In some firearms, the ejection port is positioned in the receiver such that some portion of the gas, heat and powder residue is allowed to escape through the ejection port and contact an operator's face and eyes, causing pain and discomfort, distraction, and skin discoloration. This problem can be exacerbated by use of a sound suppressor, which can cause even more gas to vent out of the ejection port defined in the receiver.

The release of gas and particulate matter through the ejection port and into an operator's face and eyes during use of the firearm can be a dangerous distraction and hindrance, particularly during periods of repeat or sustained fire, as the resulting discomfort may require the operator to cease firing or look away from a target or threat in order to alleviate the problem. Such a distraction can be costly during combat and other life threatening situations where visual acuity, timing and accuracy are critical.

The problem of hot gas and particular matter escaping out of an ejection port of a firearm and into an operator's face and eyes is particularly prevalent among "bullpup" style firearms (i.e., firearms in which the action is located behind the trigger group, and usually in front of a short buttstock), including but not limited to TAVOR® rifles, such as the select-fire TAVOR® TAR-21 assault rifle manufactured by Israel Weapon Industries, Ltd., an Israeli Corporation, and the semi-automatic TAVOR® SAR rifle manufactured by IWI US, Inc. (collectively, "IWI") for the United States civilian market. TAVOR® is a registered trademark of Israel Weapon Industries, Ltd.

TAVOR® rifles function based on a long stroke piston system, wherein the piston is mechanically fixed to the bolt group and moves through the entire operating cycle. TAVOR® rifles are ambidextrous and have two ejection ports defined in the receiver of such firearms, with one ejection port positioned directly opposite the other on either side of the firearm. This feature allows such firearms to be configured on demand for right or left handed shooters by repositioning certain components on the appropriate side of the firearm. For example, a TAVOR® rifle in the right handed shooter configuration uses the ejection port on the right side of the firearm (which would be opposite the operator's face when the firearm is shouldered) to direct spent shell casings away from the operator's face, while the unused ejection port on the opposite (i.e., left) side is covered by an interchangeable ejection port cover.

However, the conventional factory TAVOR® ejection port cover only prevents spent shall casings from being ejected through the unused ejection port and to prevent external debris from entering the receiver and fouling the action of the firearm. The conventional ejection port cover does nothing to prevent gas and powder residue from escaping out of the unused ejection port nearest the operator's face and allows hot gas and powder residue to vent through such ejection port directly into the face of the operator.

What is needed then are improvements in ejection port covers for firearms.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a device for covering an ejection port of a firearm, the firearm including a receiver having an interior side and an exterior side, the ejection port defined in the receiver, the ejection port having an upper peripheral edge and a notch defined in the upper peripheral edge of the ejection port. The device includes a backing member positionable across the ejection port from the interior side of the receiver; a cover positionable over the ejection port from the exterior side of the receiver; and a fastener extending between the backing member and the cover, the fastener selectively tightening the backing member and the cover together to clamp the cover over the ejection port. The cover is sealingly positioned over the notch in the ejection port when the cover is clamped over the ejection port. As such, the device can help prevent or block gas, heat, and residue from passing through the ejection port and contacting an operator's face and eyes.

Another aspect of the present disclosure is an ejection port cover for a bullpup style rifle. The ejection port cover includes a backing member positionable across an interior side of an ejection port defined in a receiver of the rifle, the ejection port having an outer peripheral edge; a cover positionable over an exterior side of said ejection port; and a fastener extending between the backing member and the cover, the fastener being operable to selectively tighten the backing member and the cover together to clamp the cover over the ejection port.

The cover forms a pneumatic seal around at least a portion of the outer peripheral edge of the ejection port when the cover is clamped over the ejection port. In some embodiments, the cover can form a pneumatic seal around substantially all of the outer peripheral edge of the ejection port.

Another aspect of the present disclosure is an accessory for a firearm including a backing member positionable across an ejection port defined in a receiver of a firearm from an interior side of the receiver, the ejection port having an upper peripheral edge and a notch defined in said upper peripheral edge; a cover positionable over the ejection port from an exterior side of the receiver; a fastener extending between the backing member and the cover, the fastener being operable to selectively tighten the backing member and the cover together to clamp the cover over the ejection port; and a sling swivel socket defined in the cover. The cover can block gas in the receiver from passing through the notch in the ejection port when the cover is clamped over the ejection port.

One objective of the present disclosure is to help prevent hot gas and powder residue from escaping through the ejection port of a firearm. Another aspect of the present disclosure is to help keep gas, heat, powder residue and other particulate matter out of the face of an operator using a firearm. Still yet another aspect of the present disclosure is to cover a notch in an ejection port of a firearm.

Numerous other objects, advantages and features of the present disclosure will be readily apparent to those of skill in the art upon a review of the following drawings and description of a preferred embodiment.

DETAILED DESCRIPTION

Figure 1:
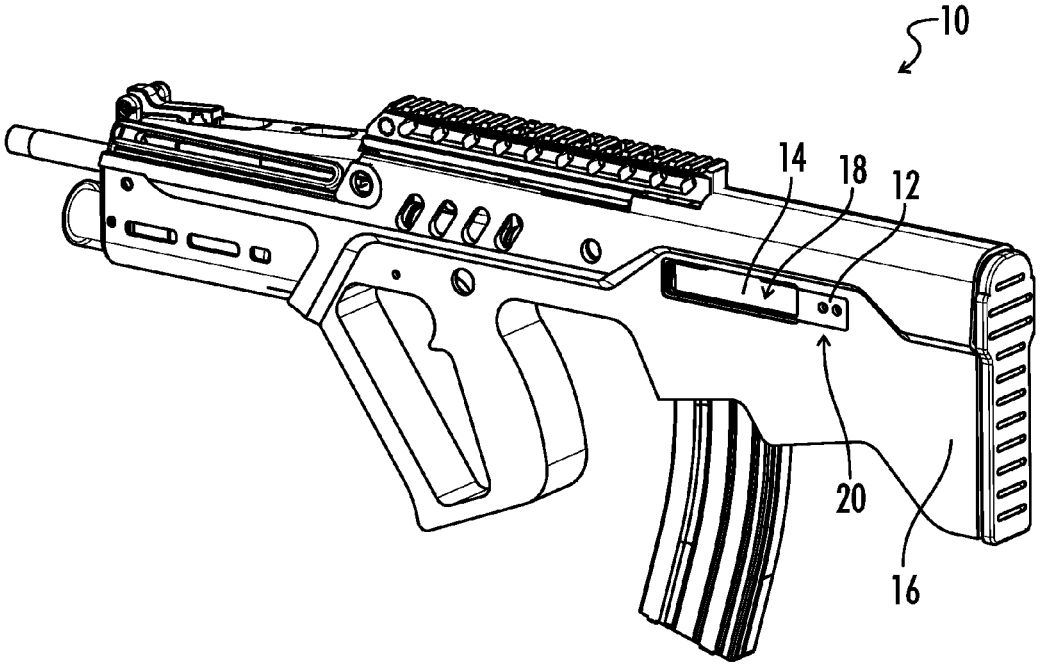
FIG. 1 is a perspective view of an embodiment of a firearm with an ejection port.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

An embodiment of a semi-automatic bullpup style firearm 10 is shown in FIG. 1. The firearm 10 can include a receiver 12 which can hold the various mechanical components of the firing mechanism, including bolt carrier 14. The receiver 12 can include an interior side and an exterior side, and an ejection port 18 defined in the receiver 12. At any point on the receiver 12, the interior side of the receiver 12 is the side that faces the internal components of the firearm 10, including but not limited to the bolt carrier 14, while the exterior side of the receiver 12 is the side facing away from the internal components of the firearm 10. In the same way, the interior side of the ejection port 18 is the side that faces the internal components of the firearm 10, while the exterior side of the ejection port 18 is the side facing away from the internal components of the firearm 10. A stock 16 can be positioned around the receiver 12 in some embodiments, the stock 16 forming at least a portion of the exterior of the firearm 10. In some embodiments, the stock 16 can be integral with the receiver 12. In FIG. 1, the stock substantially encloses the receiver 12 such that only a small portion of the receiver 12 is visible from the exterior of the firearm 10. In embodiments including a stock 16 around the receiver 12, the exterior side of the receiver 12 can face the stock 16. In some embodiments, the stock 16 can be made out of various polymer materials, and the receiver 12 can be made of a variety of metals such as steel. In other embodiments, the stock 16 and the receiver 12 can be made from a number of materials, including but not limited to, metal, metal alloys, carbon fibers, reinforced polymers, plastics, synthetic polymers, wood, etc.

The stock 16 can also include an opening 20, which corresponds with the ejection port 18. The opening 20 in the stock 16 can be positioned over the ejection port 18 and sized large enough such that the stock 16 is clear of the ejection port 18. During use of the firearm 10, after a round has been discharge, a bolt in the bolt carrier 14 can be retracted such that the spent casing can be ejected from the receiver 12 through the ejection port 18 and another round can be loaded into the chamber of the firearm 10. In some gas powered firearms, high pressure gas produced during the firing of a round can be forced back into the receiver 12 such that a bolt in the bolt carrier 14 is retracted due to the pressure from the gas to automatically eject a spent casing and load a new round into the chamber of the firearm 10. As gas is rerouted back into the receiver 12, the gas can escape through the ejection port 18, which is often located near an operator's face and eyes. In some firearms such as bullpup style TAVOR® rifles, high pressure gas produced during the firing of a round is not forced back into the receiver to operate the piston. Rather, propellant gases and particulate matter generated in the chamber can vent through the unused ejection port of such a firearm, even if the port is covered by a conventional ejection port cover. The gas, along with associated heat and powder residue, can potentially cause pain, discomfort, and skin discoloration for the operator, which is undesirable and dangerous.

Figure 2:
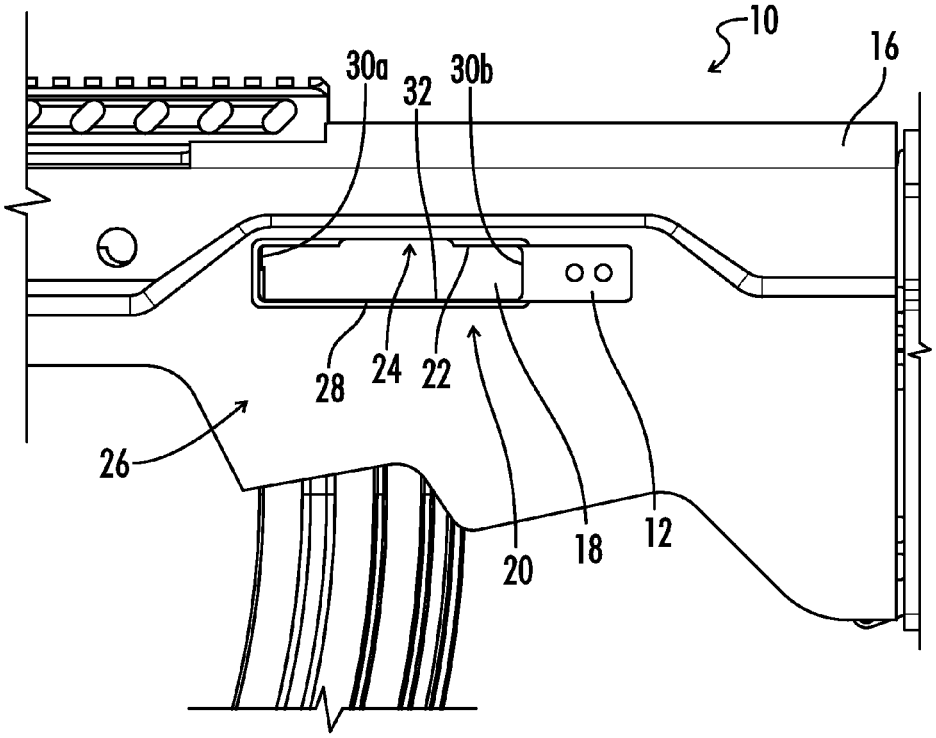
FIG. 2 is a front detailed view of the embodiment of an ejection port of FIG. 1.
Figure 3:
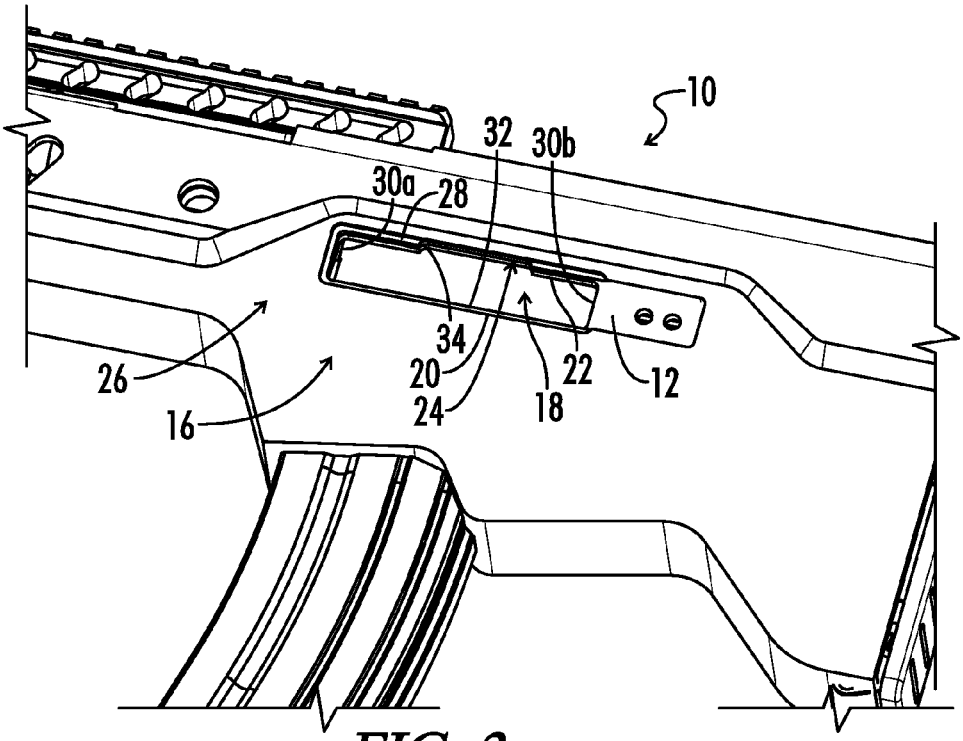
FIG. 3 is a front detailed perspective view of the ejection port of FIG. 2.

A detailed view of an embodiment of an ejection port 18 of a firearm 10 is shown in FIG. 2 and FIG. 3. In some embodiments, including those seen on IWI TAVOR® Bullpup rifles, the ejection port 18 can have an outer peripheral edge 21 including an upper peripheral edge 22 and a notch 24 defined in the upper peripheral edge 22 of the ejection port 18. The outer peripheral edge 21 can also include first lateral peripheral edge 30*a*, second lateral peripheral edge 30*b*, and lower peripheral edge 32. Additionally, in some embodiments the stock 16 can have an outer surface 26 and a recessed step 28 defined in the outer surface 26 of the stock 16, the recessed step 28 positioned around at least a portion of the outer peripheral edge 21 of the ejection port 18. In some embodiments the outer surface 28 of the stock 16 can be textured, while the recessed step 28 can include a smooth surface. As can be seen in FIG. 3, the recessed step 28 can substantially correspond to or align with the ejection port 18 in the receiver 12 along the upper peripheral edge 22, including along notch 24, first lateral peripheral edge 30*a*, and lower peripheral edge 32. As such, the stock 16 has a stock notch 34 which substantially corresponds or aligns to the notch 24 in the receiver 12.

In some embodiments, the firearm 10 can be an ambidextrous firearm 10 such that the firearm 10 can be configured for either a right-handed or a left-handed operator. In such embodiments, the receiver 12 can include two oppositely positioned ejection ports 18, one on the right hand side of the receiver 12 and one on the left hand side of the receiver 12. Such firearms 10 typically will include an ejection port cover that can be interchanged between the two ejection ports 18 such that depending on the operator's right hand or left hand dominance, the ejection port 18 closest to the operator's face during operation of the firearm 10 can be covered such that spent casings are forced to be ejected from the ejection port 18 opposite the operator's face.

Figure 4:
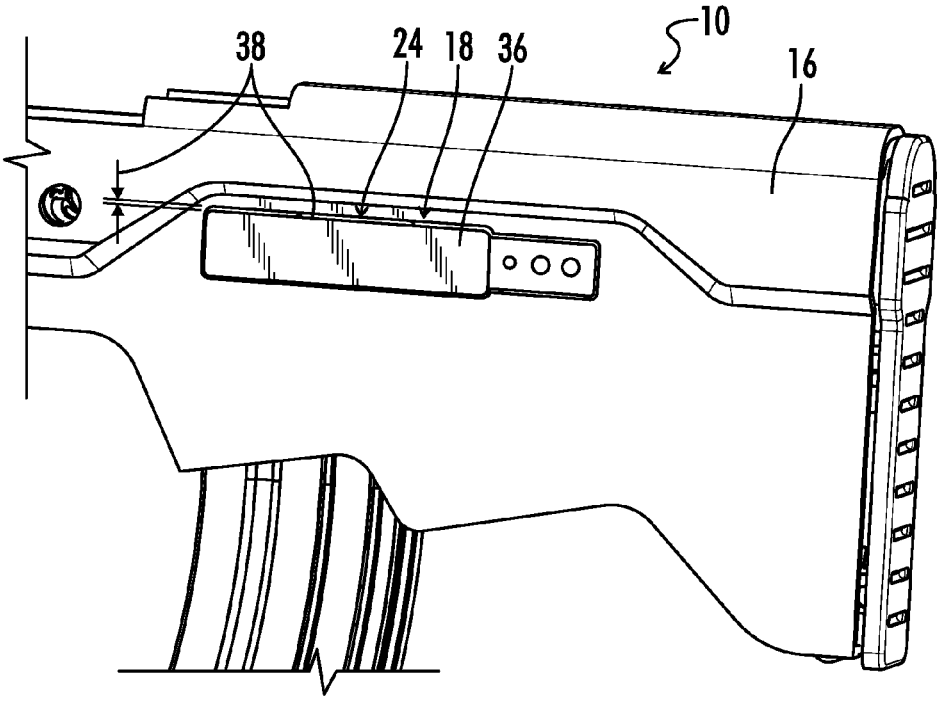
FIG. 4 is a front detailed view of an embodiment of a conventional ejection port cover.

A conventional factory ejection port cover 36 is shown in FIG. 4 attached to the ejection port 18 of FIG. 2. The factory ejection port cover 36 is designed to prevent spent casings from being ejected out of the ejection port 18 in the receiver 12 on the operator's off side and into the operator's face while firing the weapon, as well as to keep debris out of the receiver and the internal components of the firearm 10. However, as can be seen from FIG. 4, the factory cover 36 does not provide a seal around the ejection port 18 sufficient to prevent gases, heat, and other matter generated by discharging a firearm from passing through the ejection port 18 into the operator's face. Particularly, the factory cover 36 does not block or cover the notch 24 in the upper peripheral edge 21 of the ejection port 18, and therefore leaves a gap 38 formed by the notch 24 between the factory cover 36 and the stock 16 and receiver 12. Gases can pass through the gap 38 during operation of the firearm 10 and contact an operator's face and eyes, particularly while the firearm is shouldered on an operator's strong side.

Figure 5:
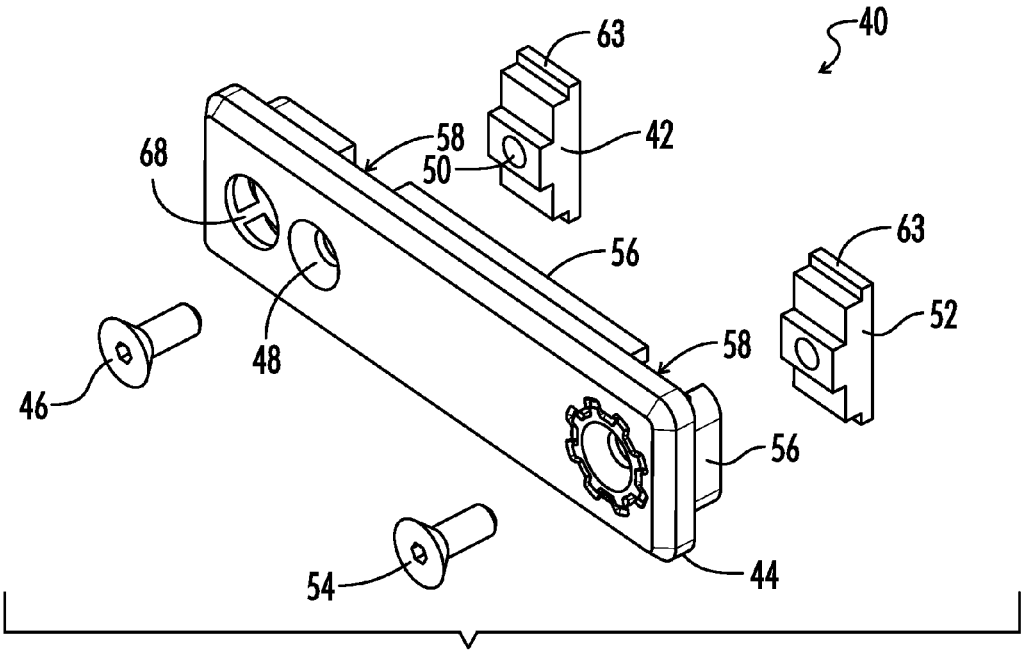
FIG. 5 is a front exploded view of an embodiment of a device for covering the ejection port of FIG. 2.
Figure 6:
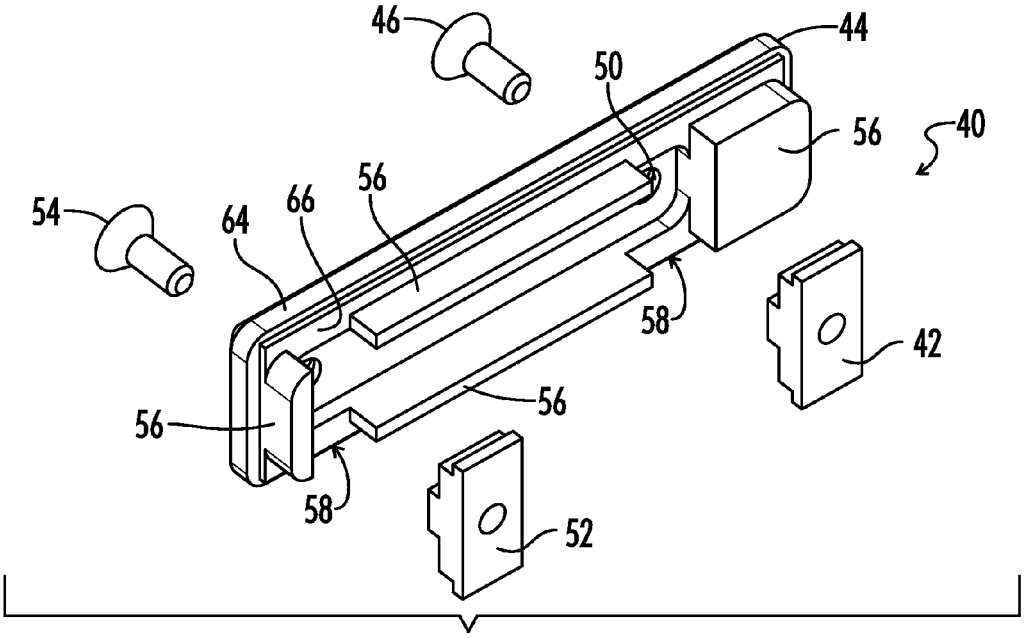
FIG. 6 is a back exploded view of the device of FIG. 5.

To combat this problem, the present disclosure provides an improved ejection port cover device 40, shown in FIG. 5 and FIG. 6, for covering an ejection port of a firearm. The device 40 includes a backing member 42 which is positionable across the ejection port of the firearm from the interior side of the receiver. A cover 44 is positionable over the ejection port from the exterior side of the receiver. A fastener 46 can extend between the backing member 42 and the cover 44. The fastener 46 can be used to selectively tighten the backing member 42 and the cover 44 together. As such, when the backing member 46 is positioned across the ejection port of a firearm from the interior side of the receiver, and the cover 44 is positioned over the ejection port from the exterior side of the receiver, the fastener 46 can extend between the cover 44 and the backing member 42 and be tightened to clamp the backing member 42 and the cover 44 together over the ejection port.

In some embodiments, the fastener 46 is a screw or bolt that can pass through a fastener through hole 48 in cover 44 and be screwed into a threaded screw hole 50 in backing member 42 to tighten the backing member 42 and the cover 44 together. In those embodiments where the firearm 10 is ambidextrous, the ejection port cover device 40 can be positionable over either ejection port 18 in the receiver such that the operator can clamp the ejection port cover device 40 over either the right side ejection port or the left side ejection port as desired.

In some embodiments, the device 40 can further include a second backing member 52 positionable across the ejection port of a firearm from the interior side of the receiver, and a second fastener 54 which can selectively tighten the second backing member 52 and the cover 44 together. As such, a first and second backing members 42 and 52 can be spaced apart across the ejection port and the cover 44 can be clamped over the ejection port at two points to provide a more balanced clamping force across the cover 44. In some embodiments, backing members 42 and 52 can be nuts that can be positioned across the ejection port 18, the nuts having threaded screw holes 50. Fasteners 46 and 54 can also be threaded and be receivable in threaded screw holes 50 of backing members 42 and 52 respectively. While the embodiment of FIG. 5 has first and second backing members 42 and 52 to provide multiple clamping points for the cover 44, in other embodiments, a single backing member can be used and the backing member can include multiple fastener receiving holes to provide multiple clamping points for the cover 44.

In some embodiments, the cover 44 of the device 40 can include one or more guide walls 56 extending from the cover 44. The guide walls 56 can be received by the ejection port when the cover 44 is clamped over the ejection port. The guide walls 56 in some embodiments can at least partially define one or more backing member gaps 58, such that as the cover 44 is clamped over the ejection port and the guide walls 56 are received by the ejection port, the backing members 42 and 52 can be received in the backing member gaps 58.

Figure 7:
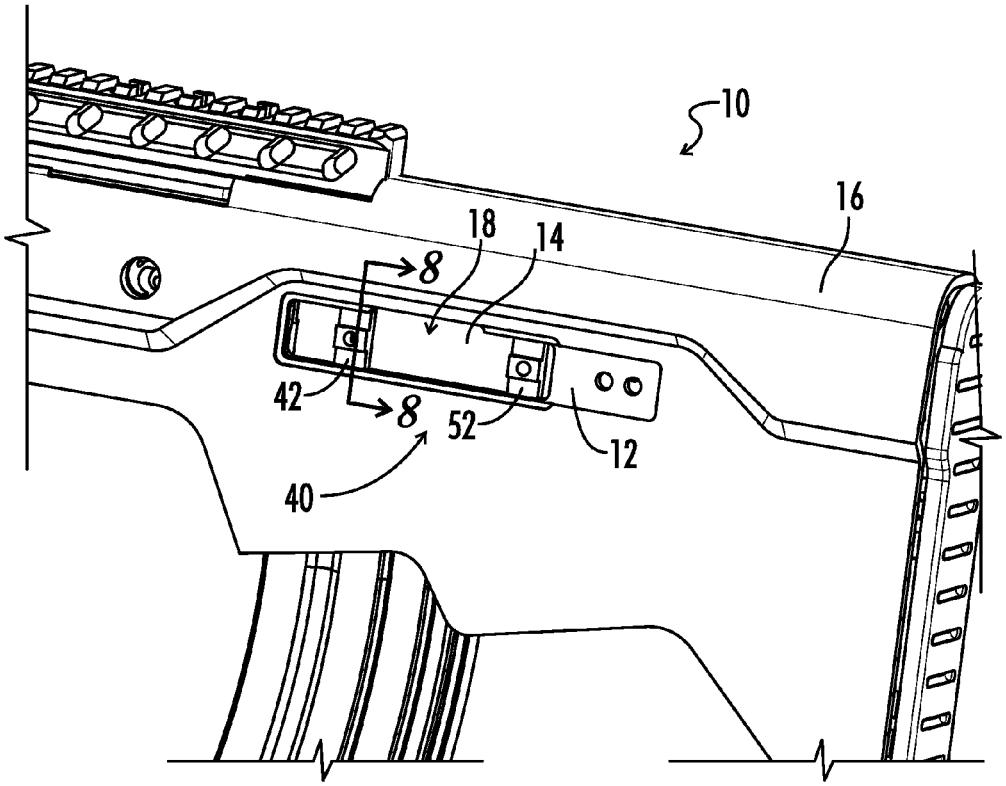
FIG. 7 is a front perspective view of backing members of the device of FIG. 5 being positioned across the ejection port of the firearm of FIG. 1 from an interior side of a receiver of the firearm.
Figure 8:
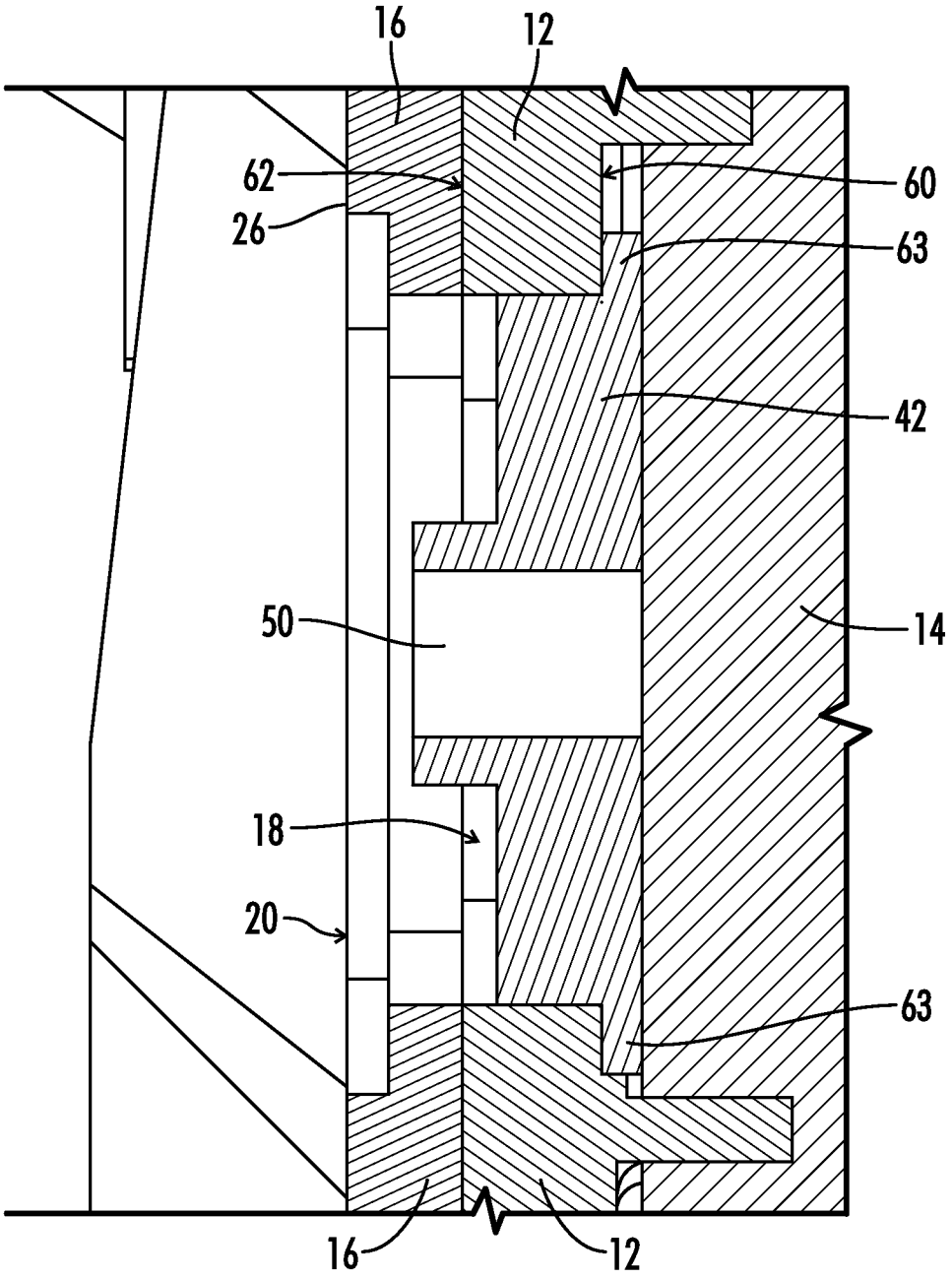
FIG. 8 is a detailed cross section view of the ejection port of FIG. 7.

FIGS. 7-13 show the device 40 of FIG. 5 being installed on a firearm. In FIG. 7-8 the backing members 42 and 52 are being positioned across the ejection port 18 from an interior side 60 of receiver 12. The stock 16 is shown in FIG. 8 positioned on the exterior side 62 of receiver 12. Backing member 42 can include a backing member flange 63 which can engage the interior side 60 of receiver 12 when backing member 42 is in position across the ejection port 18. In some embodiments, bolt carrier 14 can be positioned in receiver 12, and backing member 42 can be positionable between the receiver 12 and the bolt carrier 14, as shown in FIG. 8.

Figure 9:
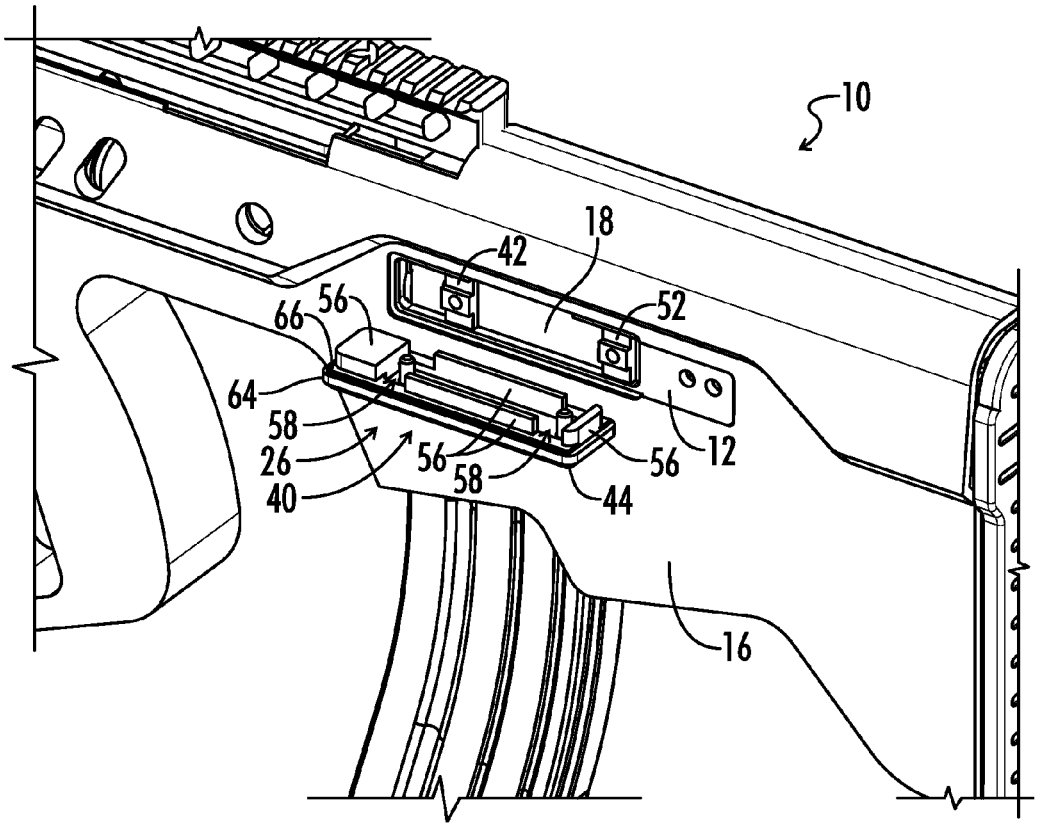
FIG. 9 is a front perspective view of the firearm of FIG. 7 showing a cover of the device of FIG. 5 being aligned with the backing members.
Figure 10:
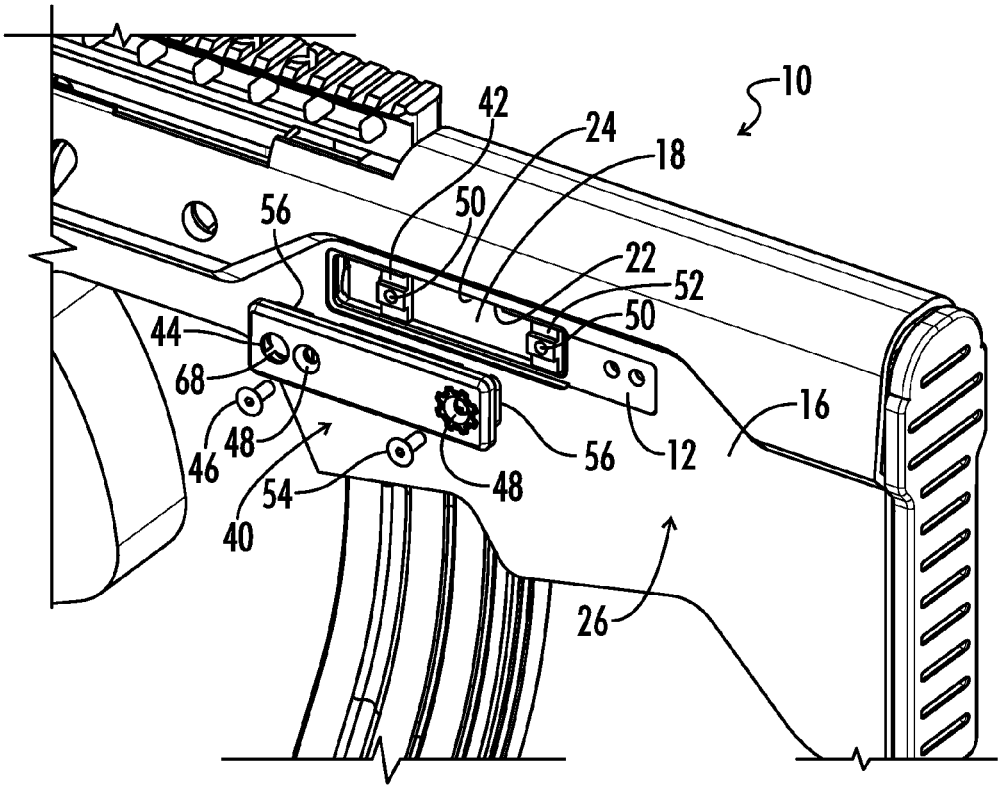
FIG. 10 is a front perspective exploded view of the cover of the device of FIG. 5 being positioned over the ejection port and of fasteners which can be used to tighten the cover and the backing members together.

Once the backing members 42 and 52 are positioned across the ejection port 18 from the interior side of the receiver 12, the cover 44 can be aligned and positioned over the ejection port 18 as shown in FIGS. 9-10. The cover 44 can be oriented such that as the cover 44 is positioned over the ejection port 18, guide walls 56 are received by and inserted into ejection port 18. The backing members 42 and 52 can be moved and aligned with the backing member gaps 58 such that as the cover 44 is positioned over the ejection port 18 the backing members 42 and 52 can be received by the backing member gaps 58.

Once the cover 44 is positioned over the ejection port 18 and aligned with backing members 42 and 52, fasteners 46 and 54 can be inserted through respective fastener through holes 48 in the cover 44 and screwed into respective threaded screw holes 50 in backing members 42 and 52. The fasteners 46 and 54 can tighten cover 44 together with first backing member 42 and second backing member 52 respectively to effectively clamp cover 44 over ejection port 18. As can be seen from FIGS. 10 and 11, when the cover 44 is clamped over the ejection port 18, the cover 44 is positioned over the notch 24 in the upper peripheral edge 22 of the ejection port 18. As such, the cover 44 can help prevent or block gas, heat, and residue from passing through the ejection port 18 and particularly the notch 24 in the ejection port 18 when the cover 44 is clamped over the ejection port 18.

Figure 11:
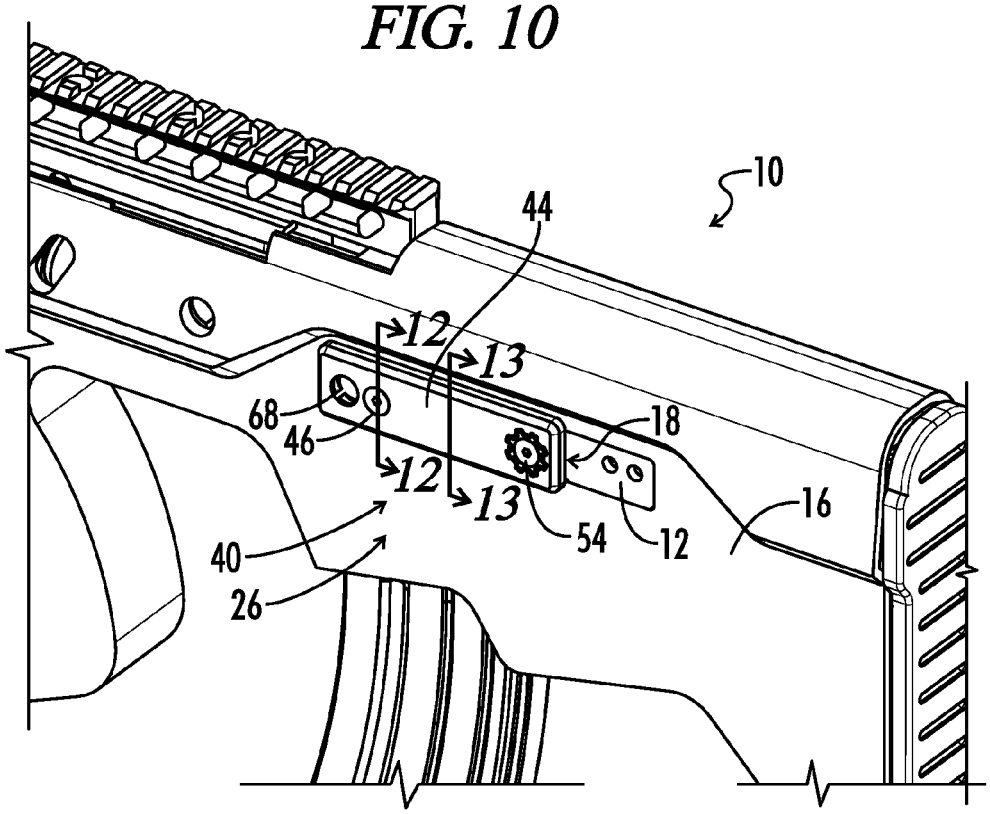
FIG. 11 is a front perspective view of the device of FIG. 5 fully assembled on the firearm of FIG. 1.
Figure 12:
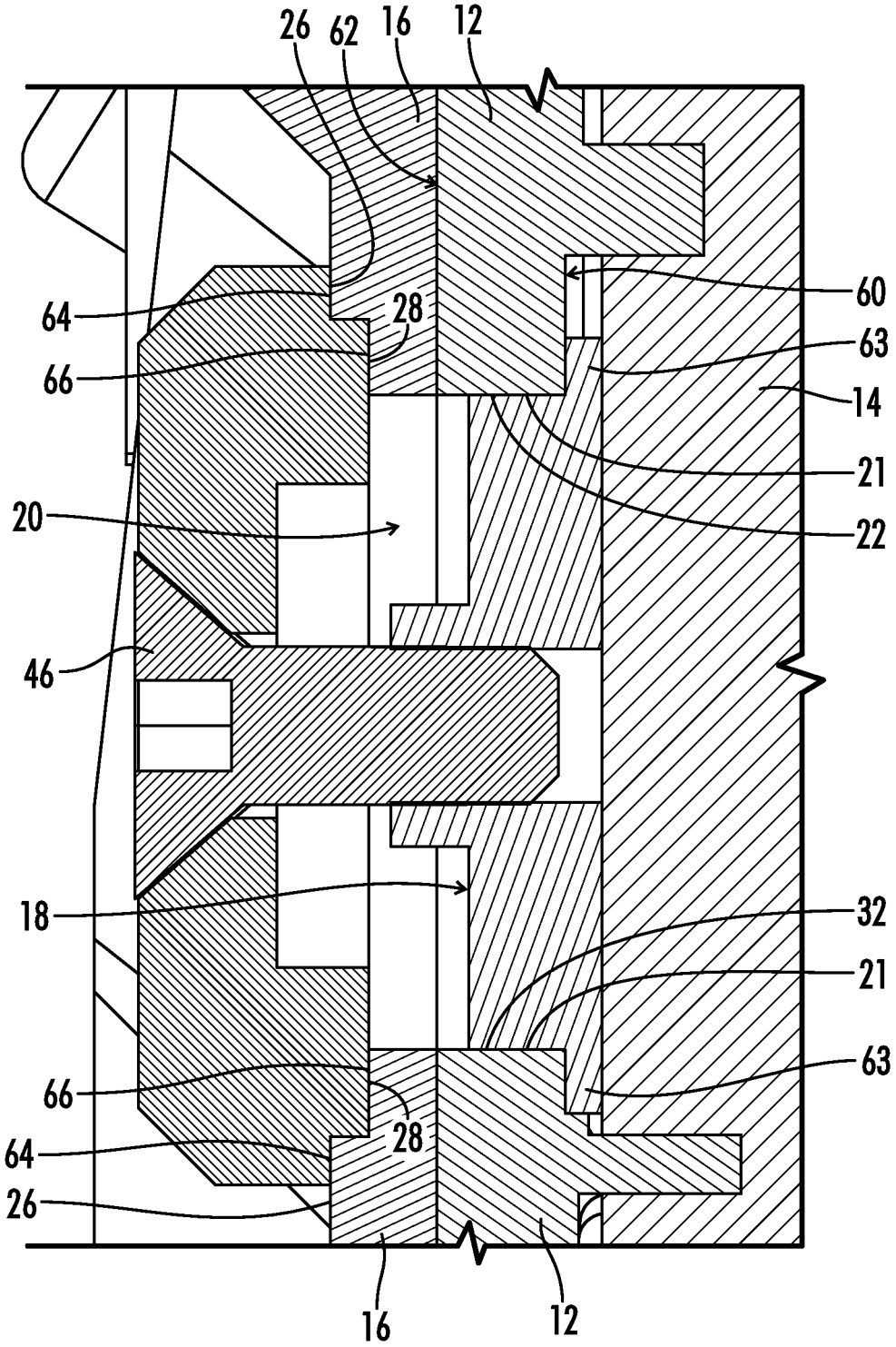
FIG. 12 is a cross section view of the ejection port cover of FIG. 11.

A cross section view of FIG. 11 showing the cover 44 clamped over the ejection port 18 is shown in FIG. 12. As the fastener 46 tightens the backing member 42 and the cover 44 together, the cover 44 in some embodiments can engage the stock 16 to effectively cover the ejection port 18. In other embodiments, the opening 20 in the stock 16 can be offset from the outer peripheral edge 21 of the receiver 12 such that the cover 44 can engage the receiver 12 directly when the cover 44 is clamped over the ejection port. In some embodiments, the cover 44 can be sized to span the entire ejection port 18 when the cover 44 is clamped over the ejection port 18. In some embodiments, the cover 44 can form a pneumatic seal around at least a portion of the outer peripheral edge 21 of the ejection port 18. FIG. 12 shows the cover 44 forming a seal around the upper peripheral edge 22 and the lower peripheral edge 30 of the ejection port 18. In some embodiments, the cover 44 can also form a pneumatic seal around first lateral peripheral edge and second lateral peripheral edge of the ejection port 18. In some embodiments, the cover 44 can form a pneumatic seal around substantially all of the outer peripheral edge 21 of the ejection port 18. Substantially all of the outer peripheral edge 21 of the ejection port 18 can be defined as at least eighty percent of the outer peripheral edge 21. In other embodiments, the cover 44 can form a pneumatic seal around at least ninety percent of the outer peripheral edge 21. In still other embodiments, the cover 44 can form a pneumatic seal around the entire outer peripheral edge of the ejection port 18.

In some embodiments, the backing member 42 can span the entire ejection port 18 such that when the backing member 42 and the cover 44 are clamped together, the backing member 42 can produce a pneumatic seal around at least a portion of the outer peripheral edge 21 of ejection port 18 from the interior side 60 of the receiver 12. In some embodiments, backing member 42 can produce a pneumatic seal around substantially all of the outer peripheral edge 21 of the ejection port 18 from the interior side 60 of the receiver 12.

As can be seen from FIG. 6, in some embodiments, cover 44 can include a first flange 64 and a second flange 66 positioned inward from the first flange 64 toward the receiver 12 when the cover 44 is clamped over the ejection port 18. In embodiments where the stock 16 includes a recessed step 28 positioned around the ejection port 18, the first flange 64 can engage the outer surface 26 of the stock 16 to form a first seal around the ejection port 18, and the second flange 66 can engage the recessed step 28 of the stock 16 to form a second seal around the ejection port 18. As such, the cover 44 in some embodiments can provide two distinct sealing surfaces to form multiple seals around the ejection port 18 to help prevent gas, heat, and residue from passing through the ejection port 18 and into the operator's face and eyes. In still other embodiments, the cover 44 can include a single flange member that can engage the outer surface 26 of the stock 16, or in other embodiments, the single flange can engage the recessed step 28 of the stock 16. In still other embodiments, the single flange can engage the receiver 12 directly.

Figure 13:
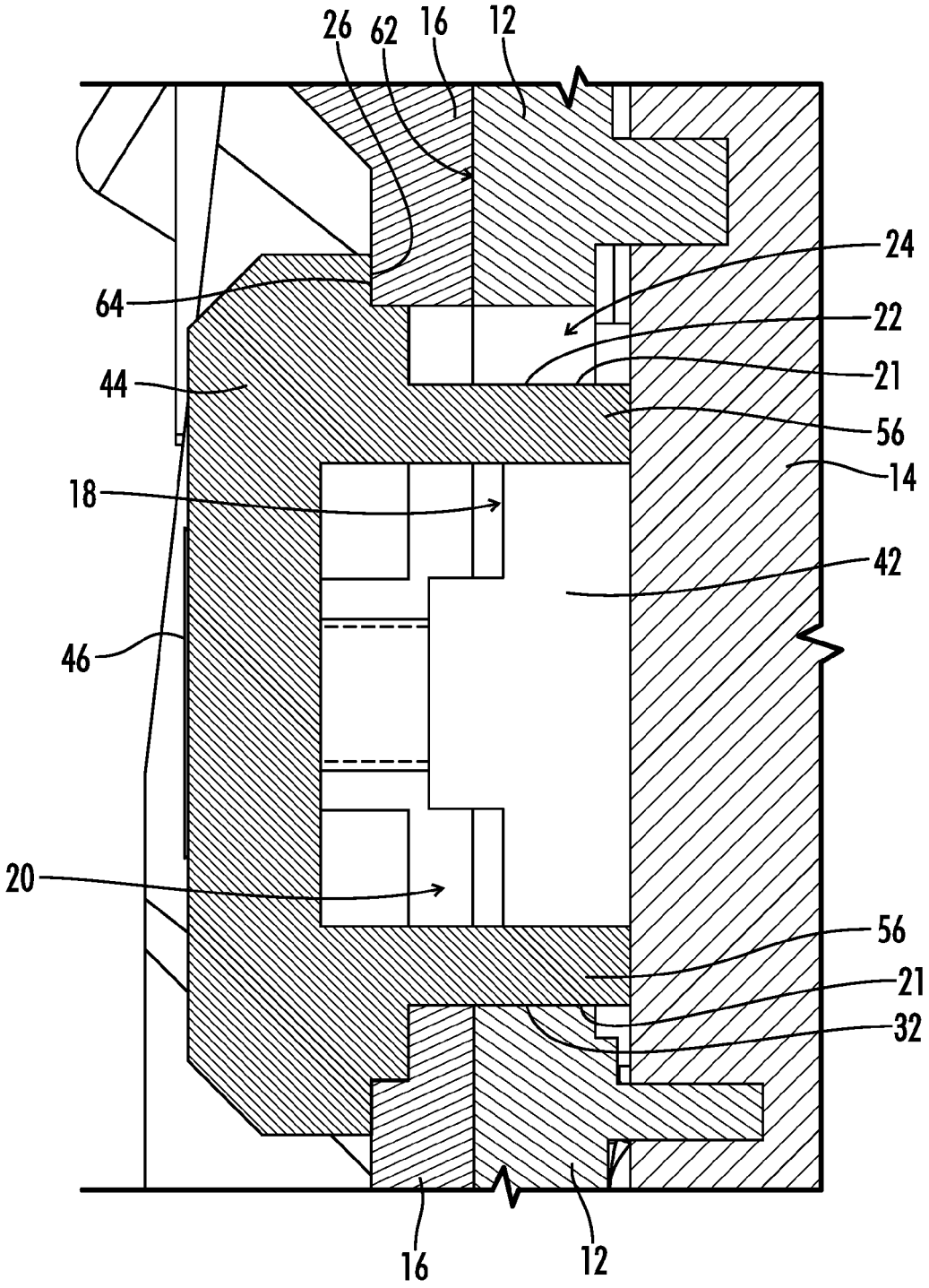
FIG. 13 is another cross section view of the ejection port cover of FIG. 11 taken across a notch in an upper edge of the ejection port.

Another cross section of FIG. 11 taken across notch 24 of the ejection port 18 is shown in FIG. 13. As can be seen in FIG. 13, when the cover 44 is clamped over ejection port 18, cover 44 is positioned over notch 24 such that the cover 44 substantially closes notch 24. Particularly, first flange 64 engages the outer surface 26 of the stock 16 such that the cover 44 overlaps the outer peripheral edge 21 of the ejection port 18, including the notch 24, and the second flange 66 is positioned directly over the notch 24. In some embodiments, the cover 44 and particularly first flange 64 can form a pneumatic seal above notch 24. As such, the cover 44 can help block or prevent gas, heat and residue from passing through the ejection port 18, and particularly through the notch 24 in the ejection port 18. Cover 44 therefore can provide an improvement over the factory cover shown in FIG. 4 which has no gas venting prevention characteristics, and especially with respect to the notch 24 in the ejection port 18.

In some embodiments, as shown in FIG. 13, the guide walls 56 on the cover 44 can be sized and oriented to produce an interference fit with the outer peripheral edge 21 of the ejection port 18. As such, the guide walls 56 can orient the cover 44 vertically and horizontally over the ejection port 18 as the cover 44 is being clamped over the ejection port 18. As such, the guide walls 56 can help ensure the proper engagement of the cover 44 with the stock 16 or the receiver 12 can be produced in order to position the cover 44 over the notch 24 and close off the ejection port 18. Proper positioning of the cover 44 over the ejection port 18 can also help ensure that a proper seal around at least a portion of the outer peripheral edge 21 of the ejection port 18 can be obtained. Additionally, the guide walls 56 producing an interference fit with the outer peripheral edge 21 of the ejection port 18 can form a third seal around the outer peripheral edge 21 of the ejection port 18, which can further help prevent gas from passing through the ejection port 18.

Referring again to FIG. 5 and FIG. 11, in some embodiments, the cover 44 can include a sling swivel socket 68. In some embodiments, the sling swivel socket 68 can be a limited rotation quick detach sling swivel socket which can receive and engage a quick detach sling swivel, such as a standard push button release sling swivel. As such, the cover 44 can provide an additional sling swivel attachment point on the firearm 10. The sling swivel socket 68 being located on the ejection port cover device 40 can help provide a sling swivel attachment point generally midway along the firearm 10, as opposed to a standard sling attachment point at the end of the firearm 10. Having a sling attached to the middle of the firearm 10 can help provide a balanced attachment point for a sling which can help optimize the range of motion of the firearm 10 when a sling attached to the firearm 10 is positioned about the operator's person.

Cover 44 can be positionable in two orientations in some embodiments such that the sling swivel socket 68 can be in a forward position on the cover, as shown in FIG. 11, or the cover 44 can be rotated 180 degrees such that the swing swivel socket 68 can be in a rearward position on the cover 44. As such, the cover 44 can provide two potential swivel attachment orientations for the firearm 10. The operator can adjust the position of the sling swivel socket 68 by flipping the cover 44 around such that the sling swivel socket 68 is in either the forward or rearward position, allowing the operator to tailor the swing swivel socket 68 location to the operator's preference.

Figure 14:
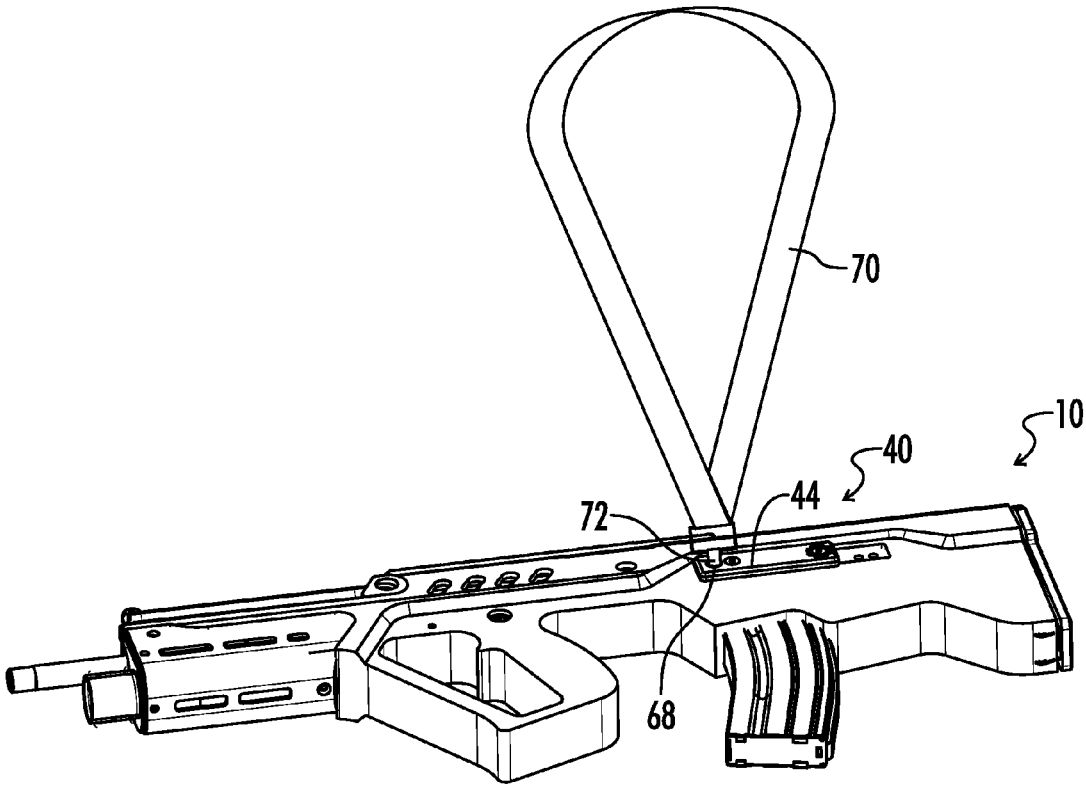
FIG. 14 shows the firearm of FIG. 11 including the ejection port cover device of FIG. 5 with a single mount sling attached to the ejection port cover device.

A sling 70 is shown attached to the sling swivel socket 68 of the firearm 10 in FIG. 14. A sling swivel 72 can be detachably connected to the sling swivel socket 68 on the cover 44 and the sling 70 can be received in the sling swivel 72. The sling 70 can then be placed around the operator's shoulders or upper body to carry the firearm 10. As shown in FIG. 14, the sling swivel attachment point location midway along the firearm 10 on the ejection port cover device 40 can provide a particularly beneficial attachment point for a single point sling arrangement, as the firearm 10 is generally balanced about the sling swivel attachment point, and the firearm 10 does not hang low to the ground when the sling 70 is positioned around an operator's shoulders. The sling swivel socket 68 located on the ejection port cover device 40 can also provide an additional attachment point for a two point sling arrangement, or a three point sling arrangement.

Thus, although there have been described particular embodiments of the present invention of a new and useful EJECTION PORT COVER FOR A FIREARM, it is not intended that such references be construed as limitations upon the scope of this invention.

What is claimed is:

1. A device for covering an ejection port defined in the receiver of a firearm, the ejection port having an upper peripheral edge and a notch defined in the upper peripheral edge of the ejection port, the device comprising:

a backing member positionable across the ejection port from an interior side of the receiver;

a cover positionable over the ejection port from an exterior side of the receiver; and a fastener extending between the backing member and the cover, the fastener being operable to selectively tighten the backing member and the cover together to clamp the cover over the ejection port;

wherein the cover is sealingly positioned over the notch in the ejection port when said cover is clamped over the ejection port.

2. The device of claim 1, wherein the cover further comprises a sling socket defined in the cover.

3. The device of claim 1, wherein the cover spans the entire ejection port when the cover is clamped over the ejection port.

4. The device of claim 1, wherein the ejection port includes an outer peripheral edge, and the cover forms a pneumatic seal around at least a portion of the outer peripheral edge of the ejection port when the cover is clamped over the ejection port.

5. The device of claim 1, wherein the receiver houses a bolt carrier, and the backing member is positionable between the receiver and the bolt carrier.

6. The device of claim 1, further comprising:

a second backing member positionable across the ejection port from the interior side of the receiver; and a second fastener extending between the cover and the second backing member, the second fastener being operable to selectively tighten the second backing member and the cover together to clamp the cover over the ejection port.

7. The device of claim 1, further comprising one or more guide walls extending from the cover, the guide walls being positioned to be received by the ejection port when the cover is clamped over the ejection port.

8. The device of claim 7, wherein the guide walls are oriented to create an interference fit with the outer peripheral edge of the ejection port when the cover is clamped over the ejection port.

9. The device of claim 7, wherein the guide walls at least partially define a backing member gap, the backing member gap receiving the backing member when the backing member and the cover are tightened together.

10. The device of claim 1, wherein the firearm includes a stock positioned on the exterior side of the receiver, the stock having an opening corresponding to the ejection port, and wherein the cover engages the stock when the cover and the backing member are tightened together and the cover is clamped over the ejection port.

11. The device of claim 10, wherein:

the stock includes a recessed step positioned about at least a portion of the ejection port; and the cover engages the recessed step in the stock when the cover is clamped over the ejection port.

12. The device of claim 11, wherein:

the stock of the firearm includes an outer surface, the recessed step being defined in the outer surface of the stock about at least a portion of the ejection port; and the cover further comprises:

a first flange; and a second flange oriented inward from the first flange toward the receiver when the cover is clamped over the ejection port;

wherein the first flange engages the outer surface of the stock to form a first seal and the second flange engages the recessed step of the stock to form a second seal when the cover is clamped over the ejection port.

13. The device of claim 1, wherein the backing member includes a backing member flange that engages the interior side of the receiver when the backing member is positioned across the ejection port from the interior side of the receiver.

14. An ejection port cover for a bullpup style rifle, comprising:

a backing member positionable across an interior side of an ejection port defined in a receiver of the rifle, the ejection port having an outer peripheral edge;

a cover positionable over an exterior side of said ejection port; and a fastener extending between the backing member and the cover, the fastener being operable to selectively tighten the backing member and the cover together to clamp the cover over the ejection port;

wherein the cover forms a pneumatic seal around at least a portion of the outer peripheral edge of the ejection port when the cover is clamped over the ejection port.

15. The ejection port cover of claim 14, wherein:

the ejection port further includes an upper peripheral edge and a notch defined in said upper peripheral edge; and the cover forms a pneumatic seal above the notch in the upper peripheral edge of the ejection port when the cover is clamped over the ejection port.

16. The ejection port cover of claim 14, wherein the cover forms a pneumatic seal around substantially all of the outer peripheral edge of the ejection port.

17. An accessory for a firearm, comprising:

a backing member positionable across an ejection port defined in a receiver of a firearm from an interior side of the receiver, the ejection port having an upper peripheral edge and a notch defined in said upper peripheral edge;

a cover positionable over the ejection port from an exterior side of the receiver; and a fastener extending between the backing member and the cover, the fastener being operable to selectively tighten the backing member and the cover together to clamp the cover over the ejection port; and a sling swivel socket defined in the cover;

wherein the cover blocks gas in the receiver from passing through the notch in the ejection port when the cover is clamped over the ejection port.

18. The accessory of claim 17, wherein the cover engages a stock positioned about the exterior side of the receiver when the cover is clamped over the ejection port, the stock having an opening corresponding to the ejection port in the receiver.

19. The accessory of claim 18, wherein:

the stock further includes a recessed step defined around at least a portion of the ejection port; and the cover engages the recessed step when the cover is clamped over the ejection port.

20. The accessory of claim 17, wherein the cover forms a pneumatic seal above the notch in the upper edge of the ejection port.

* * * * *